US005566622A

United States Patent [19]

Ziaylek, Jr. et al.

[11] Patent Number: 5,566,622

[45] Date of Patent: Oct. 22, 1996

[54] COLLAPSIBLE HOSE BRIDGING APPARATUS

[76] Inventors: Theodore Ziaylek, Jr., 140 Riverview Dr.; Michael P. Ziaylek, 15 Cold Spring Ave., both of Yardley, Pa. 19067

[21] Appl. No.: 459,397

[22] Filed: Jun. 2, 1995

[51] Int. Cl.[6] ..... B61K 13/00

[52] U.S. Cl. ..... 104/275; 174/72 C

[58] Field of Search ..... 104/275; 14/2.4, 14/73.1; 174/70 R, 70 C, 97

[56] References Cited

U.S. PATENT DOCUMENTS

| | | | |
|---|---|---|---|
| 982,924 | 1/1911 | Bardon | 104/275 |
| 1,137,313 | 4/1915 | Hamilton . | |
| 1,398,497 | 11/1921 | Tyler . | |
| 1,653,127 | 12/1927 | Shoman . | |
| 1,956,125 | 4/1934 | Leister . | |
| 2,166,031 | 7/1939 | Wendell . | |
| 2,166,516 | 7/1939 | Bainbridge . | |
| 2,299,356 | 10/1942 | Strohm et al. . | |
| 2,927,396 | 3/1960 | Hall | 104/275 |
| 3,357,370 | 12/1967 | Walkey . | |
| 3,888,186 | 6/1975 | Jentzsch et al. . | |
| 4,067,258 | 1/1978 | Valeri . | |
| 4,101,100 | 7/1978 | Smith et al. . | |
| 4,677,799 | 7/1987 | Zarembo | 104/275 |

*Primary Examiner*—Robert J. Oberleitner
*Assistant Examiner*—C. T. Bartz
*Attorney, Agent, or Firm*—Sperry, Zoda & Kane

[57] ABSTRACT

An apparatus for bridging of a hose to facilitate movement of vehicle wheels over a hose without damaging thereof which is of significant strength as well as being collapsible such as to be easily stored on emergency vehicles where limited space is available. The improved apparatus includes multi-directional ramps along with a hose bridging central member which is interconnected to multiple similarly shaped members to provide the capability of bridging one or more hoses while including ramps extending from both opposite directions. The design is particularly capable of being constructed of aluminum for lightweight advantages and includes a detachable engagement means for the ramps with respect to the central hose bridging member which is particularly advantageous when made from aluminum.

18 Claims, 3 Drawing Sheets

COLLAPSIBLE HOSE BRIDGING APPARATUS

BACKGROUND OF THE INVENTION

1. Field of the Invention

The present invention deals with the field of devices for allowing vehicles to drive across hoses, especially large fire hoses, without damaging thereof. At emergency fire sites multiple hoses extend in various directions over the roadways and driveways of adjacent areas. A hose bridging apparatus provides a means for allowing these vehicles to drive over these hoses without the vehicle itself receiving a major jolt or without the hoses themselves being damaged. Such large fire hoses are extremely costly and can easily be damaged by being repetitively crossed by one or more heavy emergency vehicles.

2. Description of the Prior Art

Many prior art designs have been utilized for bridging hose shaped configurations for driveways, pavements and even train railways such as shown in U.S. Pat. No. 1,137,313 issued Apr. 27, 1915 to C. C. Hamilton on a "Combined Fire Hose Bridge And Car Wheel Replacer"; and U.S. Pat. No. 1,398,497 issued Nov. 29, 1921 to C. P. Tyler on a "Car Rail Hose Bridge"; and U.S. Pat. No. 1,653,127 issued Dec. 20, 1927 to M. Shoman on a "Fire Hose Protector"; and U.S. Pat. No. 1,956,125 patented Apr. 24, 1934 to V. K. Leister on a "Bridge For Protecting Fire Hose"; and U.S. Pat. No. 2,166,031 issued Jul. 11, 1939 to E. J. Wendell and assigned to The Hale Fire Pump Co., Inc. on a "Hose Bridge Device"; and U.S. Pat. No. 2,166,516 issued Jul. 18, 1939 to G. A. Bainbridge on a "Ramp For The Protection Of Hose Pipes"; and U.S. Pat. No. 2,299,356 issued Oct. 20, 1942 to W. T. Strohm et al and assigned to Twentieth Century-Fox Film Corporation on a "Utility Crossover"; and U.S. Pat. No. 3,357,370 issued Dec. 12, 1967 to G. J. Walkey and assigned to Lockheed Aircraft Corporation on a "Plastic Safety Ramp"; and U.S. Pat. No. 3,888,186 issued Jun. 10, 1975 to D. Jentzsch et al and assigned to Rubber Engineering, Inc. on a "High Strength Portable Cable Crossover For High Tonnage Earth Moving Vehicles"; and U.S. Pat. No. 4,067,258 issued Jan. 10, 1978 to W. J. Valeri and assigned to Irathane Systems Incorporated on a "Crossover Unit Utilizing Slotted Pad And Wedge-Shaped Closure Strip"; and U.S. Pat. No. 4,101,100 issued Jul. 18, 1978 to D. Smith et al and assigned to Value Engineering Company on an "Aircraft Flight Line Servicing System".

SUMMARY OF THE INVENTION

The present invention provides an improved collapsible hose bridging apparatus which includes a central support member which defines a hose retaining passage extending longitudinally thereunder. The central support member preferably includes a main support plate extending above and across the hose retaining passage in such a manner as to support a heavy fire truck or other vehicle load thereabove. This main support plate will preferably be of a generally convex upwardly facing shape and will include a gripping surface thereon to facilitate gripping thereof by the motor vehicle tire. The main support plate also preferably defines a first main end at one end thereof and a second main end spatially disposed at the opposite end thereof.

A first inner leg member will be attached preferably with respect to the main support member adjacent the first main end and will extend downwardly therefrom along one side of the hose retaining passage in order to facilitate strong support of the main support plate positioned above the hose retaining passage. This first inner leg member and the first main end of the main support plate will define a first lateral slot therebetween which preferably has an arcuate cross section.

A second inner leg member will preferably be attached to the main support plate adjacent the second man end and will extend downwardly therefrom in such a manner as to facilitate supporting of the main support plate above the hose retaining passage. This second inner leg member will be preferably positioned in spaced relation from the first inner leg member in such a manner as to define the hose retaining passage therebetween. The second inner leg member and the second main end of the main support plate will define a second lateral slot means therebetween which preferably also has an arcuate cross section.

A first ramp will preferably be included having a first upper end and a first inclined plate attachable with respect to the main support plate along the first upper end thereof. The first inclined plate will preferably extend outwardly and downwardly from the first upper end to support an emergency vehicle or truck or other load thereupon. A first lower end will be positioned oppositely from the first upper end on the first plate. A first outer leg means will extend downwardly from the first inclined plate adjacent to the first lower end thereof in such a manner as to increase the stability and support thereof. This first outer leg will preferably include a first outer foot thereon to facilitate gripping therebelow. A first leg retaining chamber will also be positioned below the first inclined plate.

A first detachable engagement means will be positioned between the first upper end of the first ramp and the first upper end of the main support plate in order for detachable attachment therebetween. The first detachable engagement means will include a first lip means which is arcuate and mated for engagement with the first lateral slot. The first lip will extend outwardly from the first upper end of the first ramp. The first lip will be selectively engageable with respect to the first lateral slot in such a manner as to provide detachable engagement between the first upper end of the first ramp and the first main end of the main support plate.

A second ramp will be included having the same general shape and configuration as the first ramp. In fact, such first and second ramps will normally be completely interchangeable. The second ramp will include a second upper end as well as a second inclined plate attached with respect to the main support plate along the second upper end thereof such as to extend outwardly and downwardly therefrom in order to support an emergency vehicle, truck or other similar load thereabove. A second lower end will be oppositely positioned from the second upper end on the second plate. Also a second outer leg will extend downwardly from the second inclined plate adjacent the second lower end thereof in order to enhance stability and support thereof. The second outer leg will include a second outer foot thereon to facilitate gripping thereof by a vehicle tire or other load. The second outer leg will be positionable within the first leg retaining chamber of the first ramp means to facilitate storage thereof when detached. A second leg retaining chamber will be positioned below the second inclined plate and be adapted to receive the first outer leg of the first ramp therein for storage when detached.

A second detachable engagement means will be positioned between the second upper end of the second ramp and the second main end of the main support plate for detachable securement therebetween. The second detachable engagement means will include a second lip means which is arcuate and mated for engagement with respect to the second lateral slot. The second lip will extend outwardly from the second upper end of the second ramp. The second lip will be selectively engageable with respect to the second lateral slot in order to provide detachable engagement between the second upper end of the second ramp and the second main end of the main support plate.

Under certain situations it will be preferable to provide the improved collapsible hose bridging apparatus of the present invention in such a configuration as to contain multiple hoses extended therethrough. With such configurations the apparatus of the present invention will include an auxiliary support member positioned between the first ramp and the first main end of the main support plate. The apparatus will further include an auxiliary detachable engagement means capable of engaging the auxiliary support member with respect to the first upper end of the first ramp. This auxiliary support member will define an auxiliary hose retaining passage extending longitudinally therethrough to receive an additional hose. This auxiliary support member will be engageable with respect to the first main end of the main support plate by the first detachable engagement means. The auxiliary support member will preferably include an auxiliary support plate extending over the auxiliary hose retaining passage as well as an auxiliary leg extending downwardly from the auxiliary support plate to facilitate support thereof and to cooperate with the auxiliary support plate to define the auxiliary hose retaining passage thereadjacent.

If more than two hoses are required to be utilized, the apparatus of the present invention can include a plurality of auxiliary support members each positioned between the first ramp and the second main end of the main support plate and interconnected with respect to one another. The apparatus will further include a plurality of auxiliary detachable engagement devices which are capable of engaging the auxiliary support members with respect to one another and with respect to the first upper end of the first ramp. These auxiliary support members will each define an auxiliary hose retaining passage extending longitudinally therethrough. One of the auxiliary support members will be engageable with respect to the first main end of the main support plate by the first detachable engagement device. Each of the auxiliary support members will include an auxiliary support plate extending over the auxiliary hose retaining passage as well as on the auxiliary leg extending downwardly from the auxiliary support plate to facilitate support thereof and to cooperate therewith in such a manner as to define the auxiliary hose retaining passage thereadjacent.

It is an object of the present invention to provide an improved collapsible hose bridging apparatus wherein initial capital cost is minimized.

It is an object of the present invention to provide an improved collapsible hose bridging apparatus wherein manufacture from aluminum and other lightweight metals is possible.

It is an object of the present invention to provide an improved collapsible hose bridging apparatus wherein collapsing of the apparatus is simple and easy.

It is an object of the present invention to provide an improved collapsible hose bridging apparatus wherein collapsing of the apparatus is achievable without disengaging any clips, clasps or buckles.

It is an object of the present invention to provide an improved collapsible hose bridging apparatus wherein maintenance costs are virtually nil.

It is an object of the present invention to provide an improved collapsible hose bridging apparatus wherein the entire apparatus can be collapsed to a very small space because the oppositely positioned ramps interlock with respect to one another within a confined area.

It is an object of the present invention to provide an improved collapsible hose bridging apparatus wherein a gripping surface is defined on the upper surface of the hose bridging means and the lateral ramps.

It is an object of the present invention to provide an improved collapsible hose bridging apparatus wherein rubber ground engaging feet are included to enhance stability when positioned upon a road, highway or other flat substrate.

It is an object of the present invention to provide an improved collapsible hose bridging apparatus wherein setup of the apparatus from the collapsed configuration is virtually instantaneous.

It is an object of the present invention to provide an improved collapsible hose bridging apparatus wherein two ramps are utilized each having the same identical configuration thereby negating the necessity of having different part numbers or different manufactured configurations for each opposite ramp design.

It is an object of the present invention to provide an improved collapsible hose bridging apparatus wherein auxiliary support members can be utilized for use of the apparatus of the present invention with more than one hose.

It is an object of the present invention to provide an improved collapsible hose bridging apparatus wherein an engagement means is included utilizing a slot and lip configuration between the ramp and the central support member which can be interconnected by engagement therebetween thereby allowing the use of aluminum to construct the bridging apparatus which would otherwise be possible due to "gathering" by the aluminum material.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
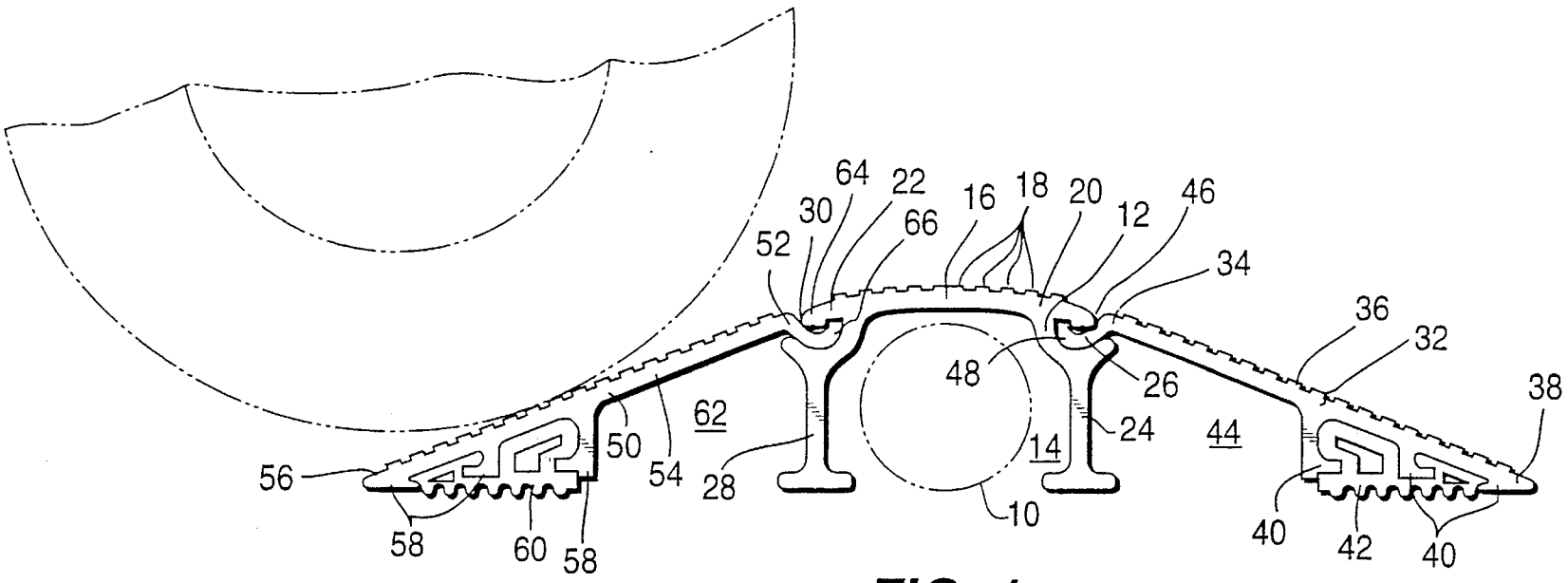
FIG. 1 is a front plan view of an embodiment of the improved collapsible hose bridging apparatus of the present invention.
Figure 2:
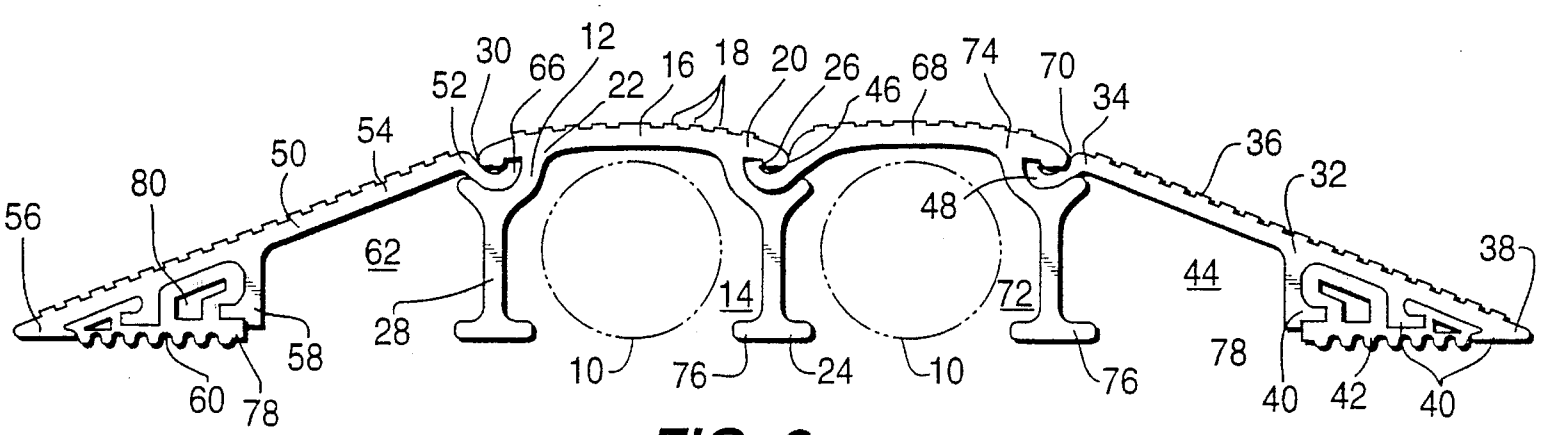
FIG. 2 is a side plan view of an alternative embodiment of the improved collapsible hose bridging apparatus of the present invention shown with an auxiliary support member.
Figure 3:
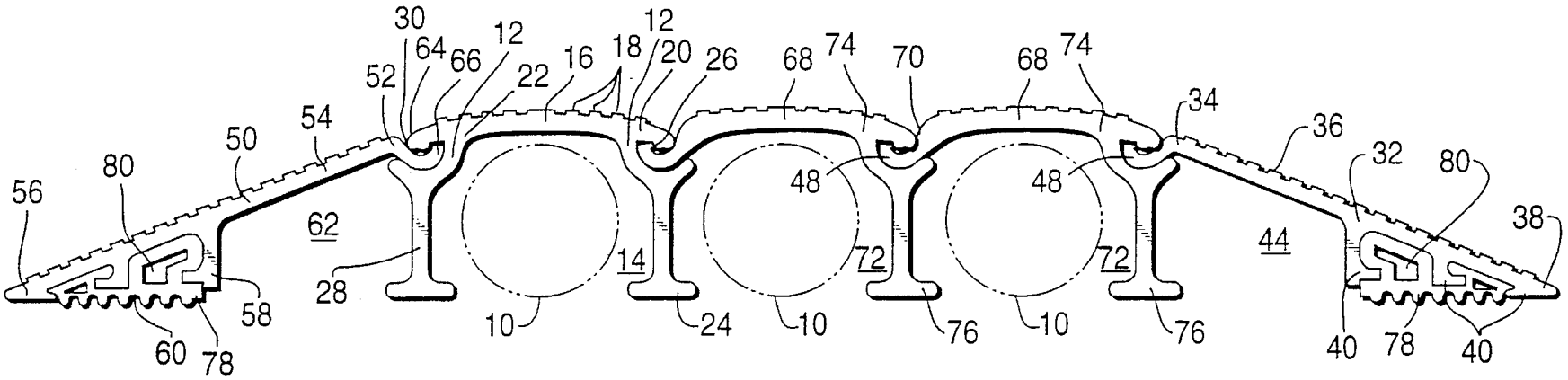
FIG. 3 is a front plan view of an alternative embodiment of the improved collapsible hose bridging apparatus of the present invention shown with two auxiliary support members for protecting three hoses.

The present invention provides an improved collapsible hose bridging apparatus including a central support member 12 defining a hose retaining passage 14 therebelow for receiving a hose 10 extending therethrough. The central support member 12 includes a main support plate 16 being of a generally convex shape facing upwardly and including a gripping surface 18 thereon to facilitate gripping thereof by a motor vehicle tire. The main support plate 16 includes a first main end 20 and a second main end 22 at the opposite end thereof.

A first inner leg member 24 will be secured to the first main end 20 of the main support plate 16 and extend downwardly therefrom to facilitate supporting of plate 16 above the hose 10 retained therebelow. In a similar manner a second inner leg member 28 will be secured or preferably integral with respect to the main support plate 16 such as to support this plate vertically above the hose 10 retained within the hose retaining passage 14 therebelow.

A first ramp 32 will include a first upper end 34 and a first lower end 38 with a first inclined plate 36 extending therebetween. The first lower end 38 will be positioned adjacent to the driveway or substrate and the first inclined plate 36 will extend upwardly and outwardly therefrom to terminate at the first upper end 34 thereof which is preferably positioned adjacent to the main support plate 16 to facilitate rolling of a vehicle tire from the first inclined plate 36 onto the support plate 16. The first ramp 32 will preferably include a first outer leg 40 which preferably includes a first outer foot 42 of rubber or other material which facilitates securement with the pavement while at the same time allowing the leg 40 to provide vertical securement for positioning of the first ramp 32.

A first detachable engagement means 46 will be included to interconnect the first upper end 34 of the first ramp 32 with respect to the first main end 20 of the main support plate 16. This detachable engagement means 46 can be of any configuration which is detachable but preferably will include a first lip 48 of an arcuate shape extending outwardly from the first upper end 34 of the first ramp 32. The central support member 12 will preferably define a first lateral slot 26 which is also preferably arcuate in a position between the main support plate 16 and the first inner leg member 24. The first lip 48 will preferably be capable of engaging with respect to the first lateral slot 26 such as to be detachably securable thereto and provide strong interconnection between the first ramp 32 and the central support member 12 to allow a vehicle to move in transition thereover.

In a similar manner the present invention will preferably include a second ramp 50 preferably having the same shape and configuration as the first ramp 32. In practice these two parts will be identically manufactured and will be completely interchangeable in order to further facilitate the adaptability and universality of application of the present design. The second ramp 50 will preferably include a second upper end 52 and a second lower end 56 with a second inclined plate 54 extending therebetween. The second lower end 56 is designed to contact the driveway or pavement area with the second inclined plate 54 extending upwardly and outwardly therefrom toward the central support member 12. The second inclined plate 54 will terminate in the second upper end 52 where a second detachable engagement 64 will attach the second ramp 50 with respect to the second main end 22 of the main support plate 16.

The second ramp 50 will be structurally stronger by the inclusion of a second outer leg 58 extending downwardly therefrom with a second outer foot 60 of a rubber material or the like preferably positioned on the bottom of the second outer leg 58 to maintain firm engagement between the substrate or ground area and the second ramp 50.

The second detachable engagement means 64 will preferably include a second lip 66 which preferably is of an arcuate configuration and extends outwardly from the second upper end 52 of the second ramp 50. The second detachable engagement means 64 also preferably will include a second lateral slot 30 will preferably is of an arcuate shape. This second lateral slot 30 will be defined on the central support member 12 at a position between the main support plate 16 and the second inner leg member 28 thereof. With this configuration the arcuate second lip 66 will be adapted to extend into the second lateral slot 30 in such a manner as to detachably secure the second ramp 50 with respect to the main support plate 16 of the central support member 12.

With this configuration the apparatus of the present invention can be easily assembled or disassembled when needed especially usable with emergency vehicles at the site of an emergency.

Additionally the present invention can be utilized to support more than one hose 10. With the conventional configuration the hose 10 will extend through the hose retaining passage 14 defined below the central support member 12. The ramps 32 and 50 can be spread further apart and an auxiliary support member 68 can be included which includes an auxiliary detachable engagement means 70 for attaching of the first ramp 32 to the auxiliary support member 68. With this configuration then the auxiliary support member 68 will be attached to the first main end 20 of the main support plate 16 by the first detachable securement means 46. The auxiliary support member 68 will include an auxiliary support plate 74 extending over an auxiliary hose retaining passage 72 therebelow. An auxiliary leg 76 can extend downwardly from the auxiliary support plate 74 for holding of this plate 74 in position above the hose retaining passage 72. Additional auxiliary support members 68 and detachable engagement means 70 can be included for defining multiple auxiliary hose retaining passages 72 in such a manner as to allow multiple hoses 10 to extend thereunder in desired applications. One of the unique aspects of the present invention is in the ability to be usable with one, two, three or any number of individual hoses which can be positioned adjacent to one another in such a manner as to pass under the central support member 12 and the multiple auxiliary support members 68.

In the design of the present invention one of the unique aspects if the use of the first outer foot 42 or the second outer foot 60. In a preferred configuration these designs will include a rubber insert 78 positioned within an insert slot 80 defined in the under surface of the first ramp 32 and the second ramp 50. With this configuration this rubber insert 78 will act as the first outer foot 42 and the second outer foot 60 and will contact the pavement to facilitate gripping thereof by the ramps 32 and 50 and will prevent sliding movement thereof during usage.

Figure 8:
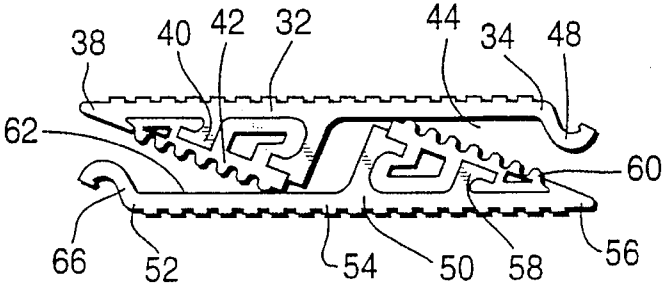
FIG. 8 is a side plan view showing an embodiment of the first ramp and an embodiment of the second ramp in the collapsed position ready for storage.
Figure 4:
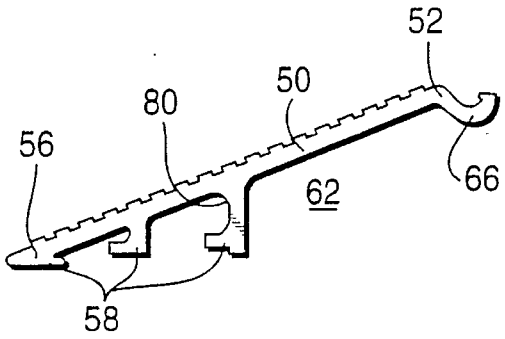
FIG. 4 is a side plan view of an embodiment of the ramp member of the present invention.
Figure 5:
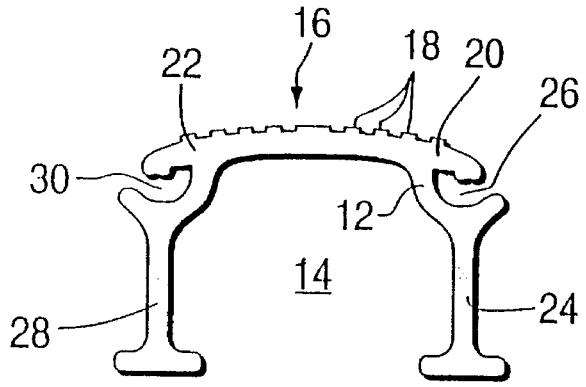
FIG. 5 is a side plan view of an embodiment of the central support member of the present invention.
Figure 6:
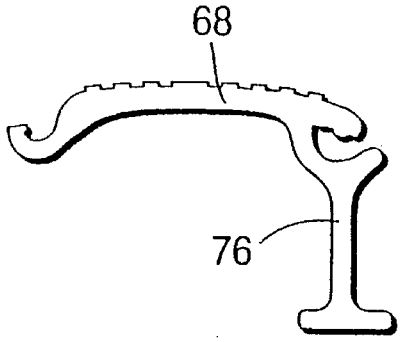
FIG. 6 is a side plan view of an embodiment of the auxiliary support member of the present invention.

The apparatus of the present invention also can be stored in a collapsed position as shown in FIG. 8. In this configuration the first leg retaining chamber 44 is shown in the undersurface of the first ramp 32. In a similar manner the second leg retaining chamber 62 is defined in the undersurface of the second ramp 50. With the ramps 32 and 50 placed in the collapsed position as shown in FIG. 8, the two ramps will mutually engage one another and collapse into a very small space which is a very important commodity on emergency vehicles. The central support member 12 and the one or more auxiliary support members 68 can be stored as desired.

Figure 7:
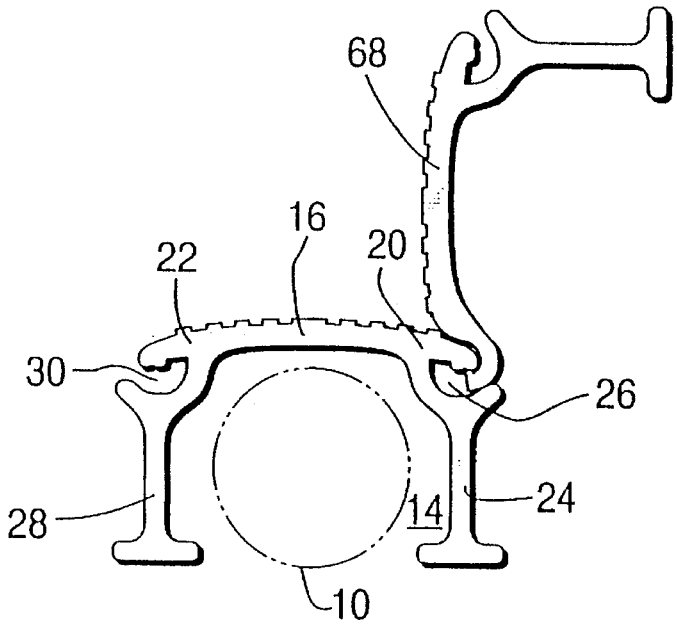
FIG. 7 is a side plan view showing moving of the auxiliary support member toward engagement with respect to the central support member.

The hose bridging apparatus of the present invention can be assembled in a quick and easy manner as shown in FIG. 7. As can be seen the central support member 12 is maintained in a steady state position and the ramp 32 or 50 will be rotated vertically 90 degrees such that the slot and lip thereof can be engaged. The auxiliary support member 68 or the ramp 32 or 50 can then be rotated downwardly to facilitate engagement between the associated lip and slot configurations. In this manner the apparatus of the present invention can be easily assembled within a very small time period.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A collapsible hose bridging apparatus comprising:

A. a central support member defining a hose retaining passage extending longitudinally therethrough, said central support member including;

(1) a main support plate extending above and across said hose retaining passage for supporting a load thereabove, said main support plate defining a first main end and a second main end thereof spatially disposed from one another;

(2) a first inner leg member attached to said main support plate adjacent said first main end and extending downwardly therefrom along one side of said hose retaining passage to facilitate supporting said main support plate above said hose retaining passage, said first inner leg member and said first main end of said main support plate defining a first lateral arcuate slot means extending therebetween;

(3) a second inner leg member attached to said main support plate adjacent said second main end and extending downwardly therefrom to facilitate supporting said main support plate above said hose retaining passage, said second inner leg member being positioned in spaced relation to said first inner leg member to define said hose retaining passage therebetween;

B. a first ramp means including:

(1) a first upper end;

(2) a first inclined plate attachable with respect to said main support plate along said first upper end thereof and extending outwardly and downwardly therefrom to support a load thereupon;

(3) a first lower end oppositely positioned from said first upper end on said first plate;

C. a first detachable engagement means positioned between said first upper end of said first ramp means and said first main end of said main support plate for detachable attachment therebetween;

D. a second ramp means including:

(1) a second upper end;

(2) a second inclined plate attachable with respect to said main support plate along said second upper end thereof and extending outwardly and downwardly therefrom to support a load thereupon;

(3) a second lower end oppositely positioned from said second upper end on said second plate; and E. a second detachable engagement means positioned between said second upper end of said second ramp means and said second main end of said main support plate for detachable securement therebetween.

2. A collapsible hose bridging apparatus as defined in claim 1 wherein said first detachable engagement means includes a first lip means extending outwardly from said first upper end of said first ramp means, said first lip means being selectively engageable with said first lateral arcuate slot means to provide detachable engagement between said first upper end of said first ramp means and said first main end of said main support plate.

3. A collapsible hose bridging apparatus as defined in claim 2 wherein said first lip means is arcuate and mated with said first lateral arcuate slot means to be engageable therewith.

4. A collapsible hose bridging apparatus as defined in claim 1 wherein said first ramp means includes a first outer leg means extending downwardly from said first inclined plate adjacent said first lower end thereof to enhance stability and support thereof.

5. A collapsible hose bridging apparatus as defined in claim 4 wherein said first outer leg means includes a first rubber foot means thereon to facilitate gripping thereof therebelow.

6. A collapsible hose bridging apparatus as defined in claim 4 wherein said second ramp means includes a second leg retaining chamber therebelow adapted to receive said first outer leg means of said first ramp means therein for storage with said first ramp means and said second ramp means detached from said central support member and in abutment with one another.

7. A collapsible hose bridging apparatus as defined in claim 1 wherein said second inner leg member and said second main end of said main support plate define a second lateral slot means extending therebetween.

8. A collapsible hose bridging apparatus as defined in claim 7 wherein said second detachable engagement means includes a second lip means extending outwardly from said second upper end of said second ramp means, said second lip means being selectively engageable with said second lateral slot means to provide detachable engagement between said second upper end of said second ramp means and said second main end of said main support plate.

9. A collapsible hose bridging apparatus as defined in claim 7 wherein said second lateral slot means is arcuate.

10. A collapsible hose bridging apparatus as defined in claim 8 wherein said second lip means is arcuate and mated with said second lateral slot means to be engageable therewith.

11. A collapsible hose bridging apparatus as defined in claim 1 wherein said second ramp means includes a second outer leg means extending downwardly from said second inclined plate adjacent said second lower end thereof to enhance stability and support thereof.

12. A collapsible hose bridging apparatus as defined in claim 11 wherein said second outer leg means includes a second rubber foot means thereon to facilitate gripping thereof therebelow.

13. A collapsible hose bridging apparatus as defined in claim 11 wherein said first ramp means includes a first leg retaining chamber therebelow adapted to receive said second outer leg means of said second ramp means therein for storage with said second ramp means and said first ramp means detached from said central support member and in abutment with one another.

14. A collapsible hose bridging apparatus as defined in claim 1 further including an auxiliary support member positioned between said first ramp means and said first main end of said main support plate and further including an auxiliary detachable engagement means being capable of engaging said auxiliary support member with respect to said first upper end of said first ramp means, said auxiliary support member defining an auxiliary hose retaining passage extending longitudinally therethrough, said auxiliary support member being engageable with said first main end of said main support plate by said first detachable engagement means, said auxiliary support member including:

A. an auxiliary support plate extending over said auxiliary hose retaining passage; and B. an auxiliary leg means extending downwardly from said auxiliary support plate to facilitate support thereof and to cooperate therewith to define said auxiliary hose retaining passage thereadjacent.

15. A collapsible hose bridging apparatus as defined in claim 1 further including a plurality of auxiliary support members positioned between said first ramp means and said first main end of said main support plate and further including a plurality of auxiliary detachable engagement means being capable of engaging said auxiliary support members with respect to one another and with respect to said first upper end of said first ramp means, said auxiliary support members each defining an auxiliary hose retaining passage extending longitudinally therethrough, one of said auxiliary support members being engageable with said first main end of said main support plate by said first detachable engagement means, each of said auxiliary support members including:

A. an auxiliary support plate extending over said auxiliary hose retaining passage; and B. an auxiliary leg means extending downwardly from said auxiliary support plate to facilitate support thereof and to cooperate therewith to define said auxiliary hose retaining passage thereadjacent.

16. A collapsible hose bridging apparatus as defined in claim 1 wherein said first ramp means and said second ramp means are of the same size and configuration.

17. A collapsible hose bridging apparatus as defined in claim 1 wherein said main support plate of said central support member is convexly-shaped facing upwardly and includes a gripping surface thereupon to facilitate gripping therewith.

18. A collapsible hose bridging apparatus comprising:

A. a central support member defining a hose retaining passage extending longitudinally therethrough, said central support member including;

(1) a main support plate extending above and across said hose retaining passage for supporting a load thereabove, said main support plate being generally convex and including a gripping surface thereon to facilitate gripping thereof, said main support plate defining a first main end and a second main end thereof spatially disposed from one another;

(2) a first inner leg member attached to said main support plate adjacent said first main end and extending downwardly therefrom along one side of said hose retaining passage to facilitate supporting said main support plate above said hose retaining passage, said first inner leg member and said first main end of said main support plate defining a first lateral arcuate slot means therebetween;

(3) a second inner leg member attached to said main support plate adjacent said second main end and extending downwardly therefrom to facilitate supporting said main support plate above said hose retaining passage, said second inner leg member being positioned in spaced relation to said first inner leg member to define said hose retaining passage therebetween, said second inner leg member and said second main end of said main support plate defining a second lateral slot means therebetween being arcuate;

B. a first ramp means including:

(1) a first upper end;

(2) a first inclined plate attachable with respect to said main support plate along said first upper end thereof and extending outwardly and downwardly therefrom to support a load thereupon;

(3) a first lower end oppositely positioned from said first upper end on said first plate;

(4) a first outer leg means extending downwardly from said first inclined plate adjacent said first lower end thereof to enhance stability and support thereof, said first outer leg means including a first outer foot means thereon to facilitate gripping thereof therebelow;

(5) a first leg retaining chamber positioned below said first inclined plate;

C. a first detachable engagement means positioned between said first upper end of said first ramp means and said first main end of said main support plate for detachable attachment therebetween, said first detachable engagement means including a first lip means being arcuate and mated for engagement with said first lateral arcuate slot means, said first lip means extending outwardly from said first upper end of said first ramp means, said first lip means being selectively engageable with said first lateral arcuate slot means to provide detachable engagement between said first upper end of said first ramp means and said first main end of said main support plate;

D. a second ramp means having the same shape and configuration as said first ramp means and including:

(1) a second upper end;

(2) a second inclined plate attachable with respect to said main support plate along said second upper end thereof and extending outwardly and downwardly therefrom to support a load thereupon;

(3) a second lower end oppositely positioned from said second upper end on said second plate;

(4) a second outer leg means extending downwardly from said second inclined plate adjacent said second lower end thereof to enhance stability and support thereof, said second outer leg means including a second outer foot means thereon to facilitate gripping thereof therebelow, said second outer leg means being positionable within said first leg retaining chamber of said first ramp means for storage thereof;

(5) a second leg retaining chamber positioned below said second inclined plate adapted to receive said first outer leg means of said first ramp means therein for storage; and E. a second detachable engagement means positioned between said second upper end of said second ramp means and said second main end of said main support plate for detachable securement therebetween, said second detachable engagement means includes a second lip means being arcuate and mated for engagement with said second lateral slot means, said second lip means extending outwardly from said second upper end of said second ramp means, said second lip means being selectively engageable with said second lateral slot means to provide detachable engagement between said second upper end of said second ramp means and said second main end of said main support plate.

* * * * *